US005980330A

United States Patent [19]

Veselaski et al.

[11] Patent Number: 5,980,330

[45] Date of Patent: Nov. 9, 1999

[54] SNAP FIT CONTACT ASSEMBLY

[75] Inventors: Steve V. Veselaski, Bay Shore; Curt Delanoy, Massapequa, both of N.Y.

[73] Assignee: Micro Contacta Inc., Long Island, N.Y.

[21] Appl. No.: 09/046,423

[22] Filed: Mar. 23, 1998

[51] Int. Cl.[6] ..... H01R 13/432

[52] U.S. Cl. ..... 439/746; 439/733.1

[58] Field of Search ..... 439/82, 508, 744, 439/746, 747, 862, 733.1, 101, 108

[56] References Cited

U.S. PATENT DOCUMENTS 5,000,704 3/1991 Costa ..... 439/733.1
5,007,851 4/1991 Matsumoto ..... 439/733.1

*Primary Examiner*—M. L. Gellner
*Assistant Examiner*—Briggitte R. Hammond
*Attorney, Agent, or Firm*—Jay H. Maioli

[57] ABSTRACT

A snap fit electrical contact includes at least one arm bearing an electrical contact and a planar metallic base extending from one end of the arm. The planar metallic base includes a pair of deflectable snap tabs outwardly extending from a middle portion of the base, forming an acute angle with the base, and provided on opposite sides of the middle portion of the base; a pair of resilient first datum orientation tabs outwardly extending from a top portion of the base in the same direction as the pair of snap tabs, and provided on opposite sides of the top portion of the base; and a resilient second datum orientation tab outwardly extending from a middle section of the top portion of the base in the same direction as the pair of snap tabs, and forming another acute angle in the same direction as the pair of snap tabs.

9 Claims, 2 Drawing Sheets

SNAP FIT CONTACT ASSEMBLY

BACKGROUND OF THE INVENTION

The present invention relates to a snap fit contact assembly for use in electronic applications.

Currently, there are a variety of kinds of electric contacts that are attached to plastic bases using methods such as heat-stake joining, insert molding, and mechanical methods such as snap fitting.

These electric contacts are often used in applications where the contacts are exposed to high vibration environments, such as in automotive throttle positioning sensors.

A problem with present electrical contacts is the difficulty of accurately locating the electrical contact with respect to the plastic base.

Another problem with present electrical contacts is the difficulty of securing the contact to the plastic base in order to reduce the electrical noise induced by the environmental vibration.

OBJECTS AND SUMMARY OF THE INVENTION

The present invention is intended to overcome the above problems and consists of a snap fit electrical assembly that can be precisely placed in a carrier base and securely attached thereto.

It is an object of the present invention to provide a snap fit electrical contact with a self-locking feature that can be precisely placed in a carrier base and securely locked thereto.

It is another object of the present invention to provide a snap fit electrical contact with a snap tab for locking against an angled transition zone of the carrier base.

It is a further object of the present invention to provide a snap fit electrical contact with a pair of datum orientation tabs to press against an opposing slot surface formed in the carrier base, thereby providing improved retention of the contact due to a slight interference fit.

In accordance with one aspect of the present invention, a snap fit electrical contact is provided including at least one arm bearing an electrical contact and extending to a planar metallic base. The planar metallic base includes a pair of deflectable snap tabs outwardly extending from a middle portion of the base, forming an acute angle with the base and provided on opposite sides of the middle portion of the base; a pair of resilient first datum orientation tabs outwardly extending from a top portion of the base in the same direction as the pair of snap tabs and provided on opposite sides of the top portion of the base, and a resilient second datum orientation tab outwardly extending from a middle section of the top portion of the base in the same direction as the pair of snap tabs and forming another acute angle in the same direction as the pair of snap tabs.

In accordance with another aspect of the present invention a snap fit electrical assembly is provided including at least one arm bearing an electrical contact and extending to a planar metallic base integrally formed therewith. The planar base includes a pair of deflectable snap tabs outwardly extending from a middle portion of the base, forming an acute angle with the base and provided on opposite sides of the middle portion of the base; a pair of resilient first datum orientation tabs outwardly extending from a top portion of the base in a same direction as the pair of snap tabs and provided on opposite sides of the top portion of the base; a resilient second datum orientation tab outwardly extending from a middle section of the top portion of the base in the same direction as the pair of snap tabs and forming another acute angle in a same direction as the pair of snap tabs; and a carrier slot adapted to receive the snap fit electrical contact having a slot datum surface and an opposing parallel surface defining a rectangular slot terminating in a transition area angled in a direction away from the slot datum surface.

These and other objects, advantages, aspects, and features of the present invention will become apparent to those skilled in the art upon consideration of the following description of the present invention.

DETAILED DESCRIPTION OF THE INVENTION

Figure 1:
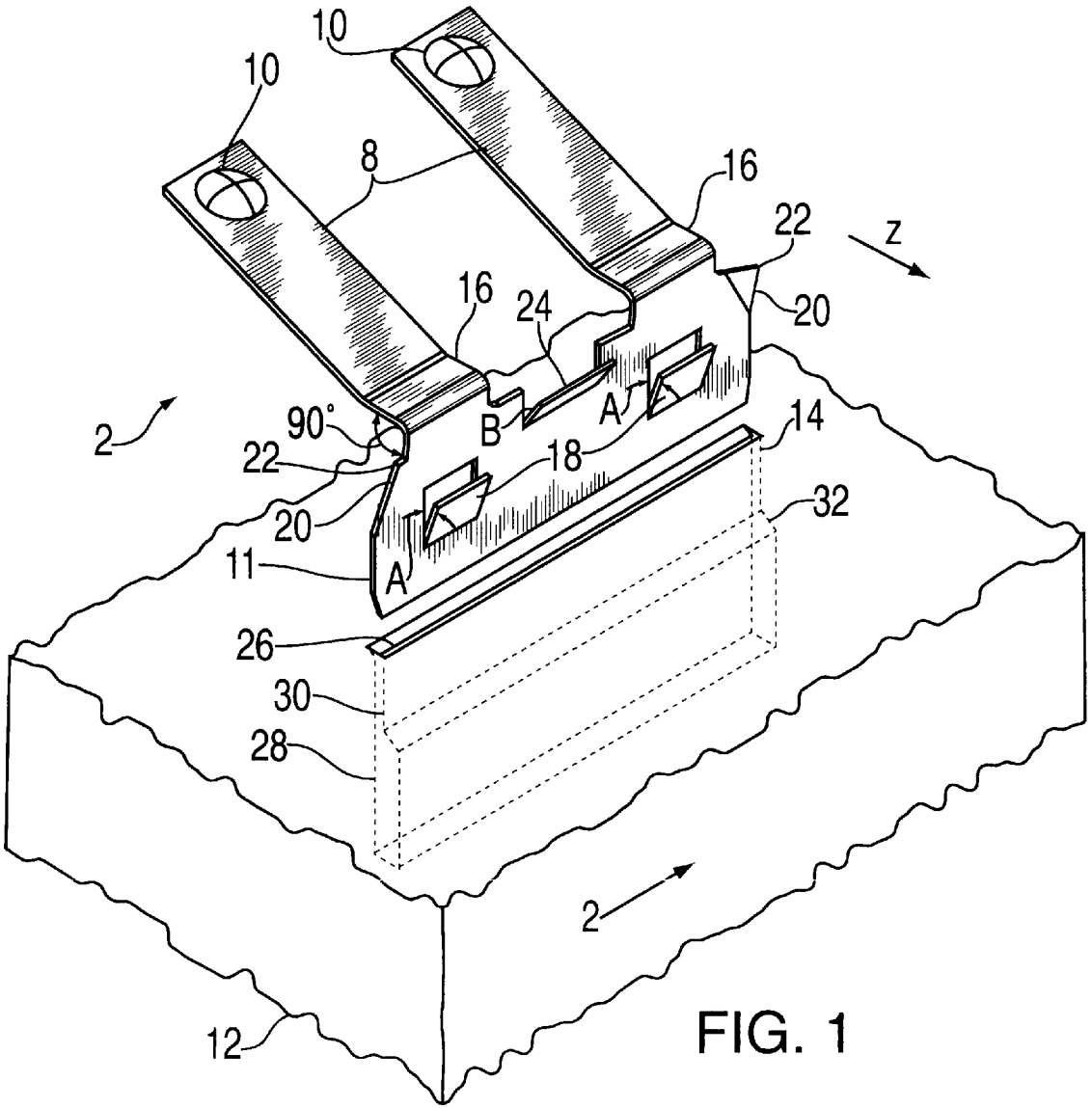
FIG. 1 shows a snap fit electrical assembly according to an embodiment of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawing.

Turning now to FIG. 1, a snap fit contact assembly according to an embodiment of the present invention will be described. The snap fit contact assembly includes a pair of arms 8 bearing electrical contacts 10 configured depending on the application, a planar base 11 extending from ends of the arms 8 opposite the electrical contacts 10 and a carrier 12 having a slot 14 adapted to receive the base 11. The arms 8 bearing the contacts 10 and the base 11 are integrally formed of a metallic material such as brass, copper or any precious metal. The carrier 12 is of a plastic material in this embodiment of the present invention but could also be made of metal. Further, FIG. 1 shows two arms 8 and contacts 10 but it is possible to have only one contact arm or more than two contact arms depending on the application.

Figure 4:
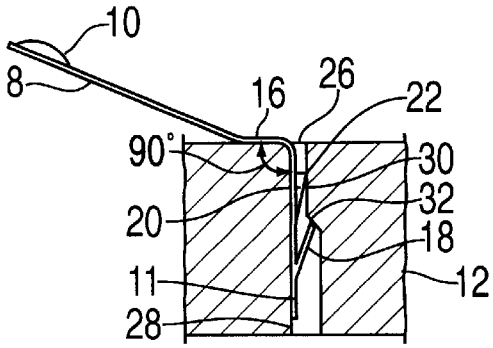
FIG. 4 is a cross-sectional view showing the snap fit electrical contact in a full inserted position with the snap tabs in a locked position against an angled transition zone of the carrier base according to an embodiment of the present invention.

The contact arms 8 each have a planar portion 16 forming a 90-degree angle with the base 11 in this embodiment of the present invention. These planar portions 16 are used to locate the contact arms 8 on the carrier 12 with high precision, as illustrated in FIG. 4.

Further, looking at FIG. 1, the base 11 includes a pair of deflectable snap tabs 18 forming an acute angle A with the major surface of the base 11. The snap tabs 18 extend from a middle portion of the base 11 in a direction indicated by the arrow Z. In a top portion of the base 11, there is provided a pair of resilient datum orientation tabs 20 also extending from the major surface of base 11 in the direction of the arrow Z and located on opposite side edges of the top portion. These datum orientation tabs 20 are triangular in shape and terminate in sharp points 22. Another datum orientation tab 24 is located in a middle section of the top portion of the base 11 and extends outwardly therefrom forming another acute angle B with the base 11. The datum orientation tab 24 also extends from the base 11 in the direction of the arrow Z. In this embodiment of the present invention the datum orientation tabs 20, 24 are slightly less flexible than the snap tabs 18. Further, in this embodiment the datum orientation tabs 18 have a thickness of 0.003 inches.

The slot 14 formed in the carrier 12 has an opening 26 formed to receive the base 11. The slot 14 has a slot datum surface 28, used as a reference plane to measure all critical dimensions, and an opposing parallel surface 30. The opposing parallel surface 30 terminates in an angled transition zone 32 or shoulder formed sloping in the direction indicated by the arrow Z.

Figure 2:
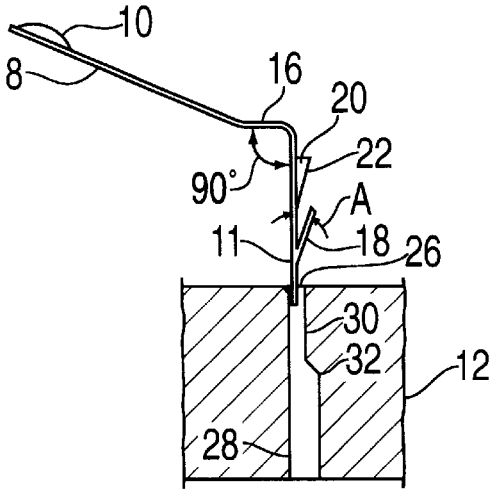
FIG. 2 is a cross-sectional view showing the snap fit electrical contact before being inserted in a carrier base with the snap tabs in a free extended position according to an embodiment of the present invention.

Turning now to FIG. 2, which is a cross-section taken along section lines 2—2 of FIG. 1, we see the base 11 poised above the carrier 12 with the snap tabs 18 in a free extended position before they are inserted into the slot 14 of the carrier 12.

Figure 3:
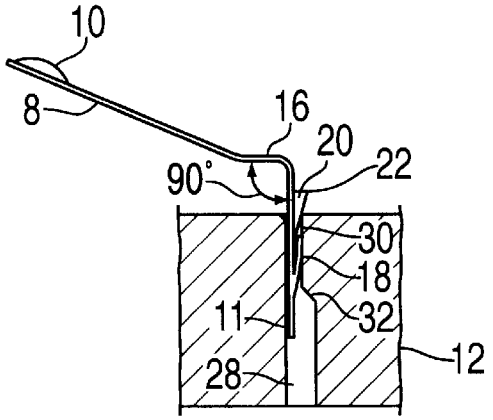
FIG. 3 is a cross-sectional view showing the snap fit electrical contact while being inserted in the carrier base with the snap tabs in a compressed position according to an embodiment of the present invention.

While in FIG. 3, we see the snap tabs 18 in a compressed position while they are being inserted into the slot 14.

In the assembled state shown in FIG. 4, we see the snap tabs 18 in a locked position against the angled transition zone 32. It will be clear to someone skilled in the art that this angled transition zone 32 is required to create a secure lock by taking into consideration the cumulative tolerances of the assembly. For example, if this transition zone was 90 degrees it would be possible for the snap tabs 18 to lock in a loose position or not lock at all because of the 90 degree angle between the planar portions 16 and the base 11.

Further, because of the sharp points 22 and a slight interference fit, the datum orientation tabs 20 will penetrate the opposing surface slightly. The datum orientation tabs 20 assist in the retention of the base 11 in the slot 14, and stabilize the base 11 from a rocking movement in the slot 14.

It would be obvious to someone skilled in the art to modify the embodiment of the invention described above by providing one snap tab 18 instead of the two shown in FIG. 1. Further, a plurality of datum orientation tabs 24 could be provided instead of the one shown. Furthermore, the datum orientation tabs 20, 24 and the snap tabs 18 could extend in the opposite direction of the arrow Z provided that the angled transition zone 32 is moved accordingly.

Thus, it is apparent that in accordance with the present invention an apparatus that fully satisfies the objectives, aims and advantages is set forth above. While the invention has been described in conjunction with specific embodiments, it is evident that many alternatives modifications, permutations, and variations will become apparent to those skilled in the art in the light of the foregoing description. Accordingly, it is intended that the present invention embrace all such alternatives, modifications and variations as fall within the scope of the appended claims.

What is claimed is:

1. A snap fit electrical contact, comprising an electrical contact mounted on an arm; and a substantially planar metallic base extending from one end of said arm, being integrally formed therewith, and including:

a pair of deflectable snap tabs outwardly extending from a middle portion of said base, forming a firs t acute angle with said base, and provided on opposite sides of said middle portion of said base;

a pair of resilient first datum orientation tabs outwardly extending from a top portion of said base in a same direction as said pair of snap tabs and provided on opposite sides of said top portion of said base; and a resilient second datum orientation tab outwardly extending from a middle section of said top portion of said base in the same direction as said pair of snap tabs and forming a second acute angle in a same direction as said pair of snap tabs.

2. The snap fit electrical contact as recited in claim 1, wherein said pair of resilient first datum orientation tabs terminate in a sharp point.

3. The snap fit electrical contact as recited in claim 2, wherein said resilient second datum orientation tab terminates in a linear edge.

4. A snap fit electrical assembly, comprising:

an electrical contact mounted on an arm; and a substantially planar metallic base extending from one end of said arm, and integrally formed therewith, and including:

a pair of deflectable snap tabs outwardly extending from a middle portion of said base, forming a first acute angle with said base, and provided on opposite sides of said middle portion of said base;

a pair of resilient first datum orientation tabs outwardly extending from a top portion of said base in a same direction as said pair of snap tabs and provided on opposite sides of said top portion of said base; and a resilient second datum orientation tab outwardly extending from a middle section of said top portion of said base in the same direction as said pair of snap tabs and forming a second acute angle in a same direction as said pair of snap tabs; and a carrier with a slot formed therein adapted to receive said snap fit electrical contact and having a slot datum surface and an opposing parallel surface defining a rectangular slot terminating in a transition area angled in a direction away from said slot datum surface.

5. The snap fit electrical contact assembly as recited in claim 4, wherein said pair of resilient first datum orientation tabs terminate in a sharp point.

6. The snap fit electrical contact assembly as recited in claim 5, wherein said resilient second datum orientation tab terminates in a linear edge.

7. The snap fit electrical assembly as recited in claim 6, wherein said pair of deflectable snap tabs have locking lips for securely engaging against said angled transition area, and said sharp points of said pair of resilient first datum orientation tabs resiliently contact said opposing parallel surface for securely holding said base in said carrier slot.

8. The snap fit electrical assembly as recited in claim 7, wherein said pair of resilient first datum orientation tabs are formed in a triangular shape.

9. The snap fit electrical assembly as recited in claim 8, wherein said arm includes a surface arranged at a 90-degree angle with said base.

* * * * *